US012669117B2

(12) United States Patent
Justice et al.

(10) Patent No.: US 12,669,117 B2
(45) Date of Patent: Jun. 30, 2026

(54) ELECTRIC AIR COMPRESSOR SYSTEM AND POWER REGULATOR THEREFOR

(71) Applicant: Vanair Manufacturing, Inc., Michigan City, IN (US)

(72) Inventors: Kai Justice, Wheatfield, IN (US); Trenton Rhodes, Valparaiso, IN (US); Devin Royce, Chesterton, IN (US); Lucas Bencze, Valparaiso, IN (US); Ralph Kokot, Crown Point, IN (US)

(73) Assignee: VANAIR MANUFACTURING, INC., Michigan City, IN (US)

( * ) Notice: Subject to any disclaimer, the term of this patent is extended or adjusted under 35 U.S.C. 154(b) by 0 days.

(21) Appl. No.: 17/818,030

(22) Filed: Aug. 8, 2022

(65) Prior Publication Data

US 2023/0050997 A1 Feb. 16, 2023

Related U.S. Application Data

(60) Provisional application No. 63/232,788, filed on Aug. 13, 2021.

(51) Int. Cl.
*F04B 49/06* (2006.01)
*F04B 35/04* (2006.01)

(52) U.S. Cl.
CPC ..... *F04B 49/06* (2013.01); *F04B 35/04* (2013.01)

(58) Field of Classification Search
CPC ..... F04B 49/06; F04B 49/065; F04B 53/04; H02J 7/00309; H02J 7/65; H02J 2105/54
USPC ..... 417/411; 322/33–34
See application file for complete search history.

(56) References Cited

U.S. PATENT DOCUMENTS

| | | | | |
|---|---|---|---|---|
| 5,747,909 | A * | 5/1998 | Syverson | H02H 7/06 310/156.56 |
| 9,525,291 | B1 * | 12/2016 | Huynh | B60L 3/04 |
| 2008/0196445 | A1 * | 8/2008 | Lifson | F25B 49/025 417/44.1 |
| 2009/0008374 | A1 * | 1/2009 | Fosbinder | B23K 9/10 219/133 |
| 2014/0277791 | A1 * | 9/2014 | Lenard | F02D 29/06 700/287 |
| 2019/0181718 | A1 * | 6/2019 | Arnold | H01R 27/00 |

* cited by examiner

*Primary Examiner* — Philip E Stimpert
(74) *Attorney, Agent, or Firm* — Brad C. Spencer

(57) ABSTRACT

An electric air compressor system includes an air compressor and an electric motor configured for driving the air compressor. An electric power storage device provides electric power to the electric motor. An electric generator provides electric power to the electric power storage device and/or to the electric motor. A power regulator including a processor controls operation of the electric generator. The power regulator controls operation of the electric generator based on at least one of an on/off operational state of the electric generator, the temperature of the electric generator, the temperature of the electric power storage device, the electrical current output of the electric generator, and the speed of the electric generator.

11 Claims, 3 Drawing Sheets

ELECTRIC AIR COMPRESSOR SYSTEM AND POWER REGULATOR THEREFOR

CROSS-REFERENCE TO RELATED APPLICATION

This application claims the benefit of U.S. Provisional Application No. 63/232,788 filed Aug. 13, 2021, the contents of which are incorporated herein by reference.

BACKGROUND OF THE INVENTION

This application generally relates to electric air compressor systems and power regulator therefor.

Conventional mobile power systems adapted for use in mobile applications include, as nonlimiting examples, welders, generators, hydraulic power units (HPUs), and air compressors, typically are powered by internal combustion engines, as nonlimiting examples, a gasoline engine or a diesel engine. Although effective, these systems are often heavy, loud to operate, require a myriad of filters and lubricants to service, and/or generate undesirable heat and/or noxious fumes during operation.

More recently, there has been a progression of engine powered systems being replaced with electric or hybrid systems. Such electric or hybrid mobile power systems may have several advantages over the conventional mobile power systems. For example, fully electric mobile power equipment may eliminate filters, oil, spark plugs, noxious fumes, heat, and/or noise, from an internal combustion engine. In addition, fully electric mobile power equipment may have advantages such as decreased weight in intermittent use cases, reduced wear and tear on a host vehicle, and/or provide more power than traditional small internal combustion engines. In a similar vein, hybrid mobile power equipment, i.e., equipment that is arranged to receive power from both of an electrical battery source and an internal combustion engine, can have other benefits over conventional mobile power systems. For example, hybrid mobile power equipment may decrease maintenance life cycles of the equipment, reduce noxious fumes, reduce intervals with engine noise, reduce wear and tear on a host vehicle, and/or provide more power than traditional internal combustion engines. Additional advantages of hybrid and fully electric power equipment over conventional mobile power systems may also include increased operator safety, lower maintenance needs, increased energy efficiency, fewer moving parts with corresponding fewer maintenance parts, lower weight for intermittent duty applications, smaller size, and easier installation.

A problem that can arise with such electric or hybrid systems is load management. If a user connects to many pieces of equipment to one power source and attempts to draw more power than the power source is capable of, the power source may be damaged or go into a shut-down state. This problem may be particularly acute where the power load or loads on the system vary significantly over time, such as when a piece of equipment cycles on and off or when multiple power loads can be individually turned on and off independently.

A type of mobile power system that can be affected by such considerations outlined above is a mobile air compressor system, such as an air compressor system mounted to a vehicle or used in a mobile field environment, such as at a construction site or for off-site vehicle repair. Many conventional mobile air compressor systems driven by an internal combustion engine are difficult to expand when added capacity is needed and/or may have power capacity limitations when combined with other auxiliary power loads. Therefore, it would be desirable to develop systems and devices capable of overcoming these and/or other problems.

BRIEF DESCRIPTION OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings. The present invention provides electric air compressor systems suitable for use in mobile applications.

According to some aspects of the invention, an electric air compressor system includes an air compressor and an electric motor configured to drive the air compressor. An electric power storage device provides electric power to the electric motor. An electric generator provides electric power to the electric power storage device and/or to the electric motor. A power regulator including a processor controls operation of the electric generator. The power regulator controls operation of the electric generator based on at least one of an on/off operational state of the electric generator, the temperature of the electric generator, the temperature of the electric power storage device, the electrical current output of the electric generator, and the speed of the electric generator.

According to some aspects of the invention, a power regulator is configured to control operation of an electric air compressor system having an electric generator that provides electrical power to an electric power storage device and an electric motor configured to drive an air compressor. The power regulator may include a processor configured to control operation of the electric generator based on one or more of the on/off operational state of the electric generator, the temperature of the electric generator, the temperature of the electric power storage device, the electrical current output of the electric generator, and the speed of the electric generator.

These and other aspects, arrangements, features, and/or technical effects will become apparent upon detailed inspection of the figures and the following description.

DETAILED DESCRIPTION OF THE INVENTION

Figure 1:
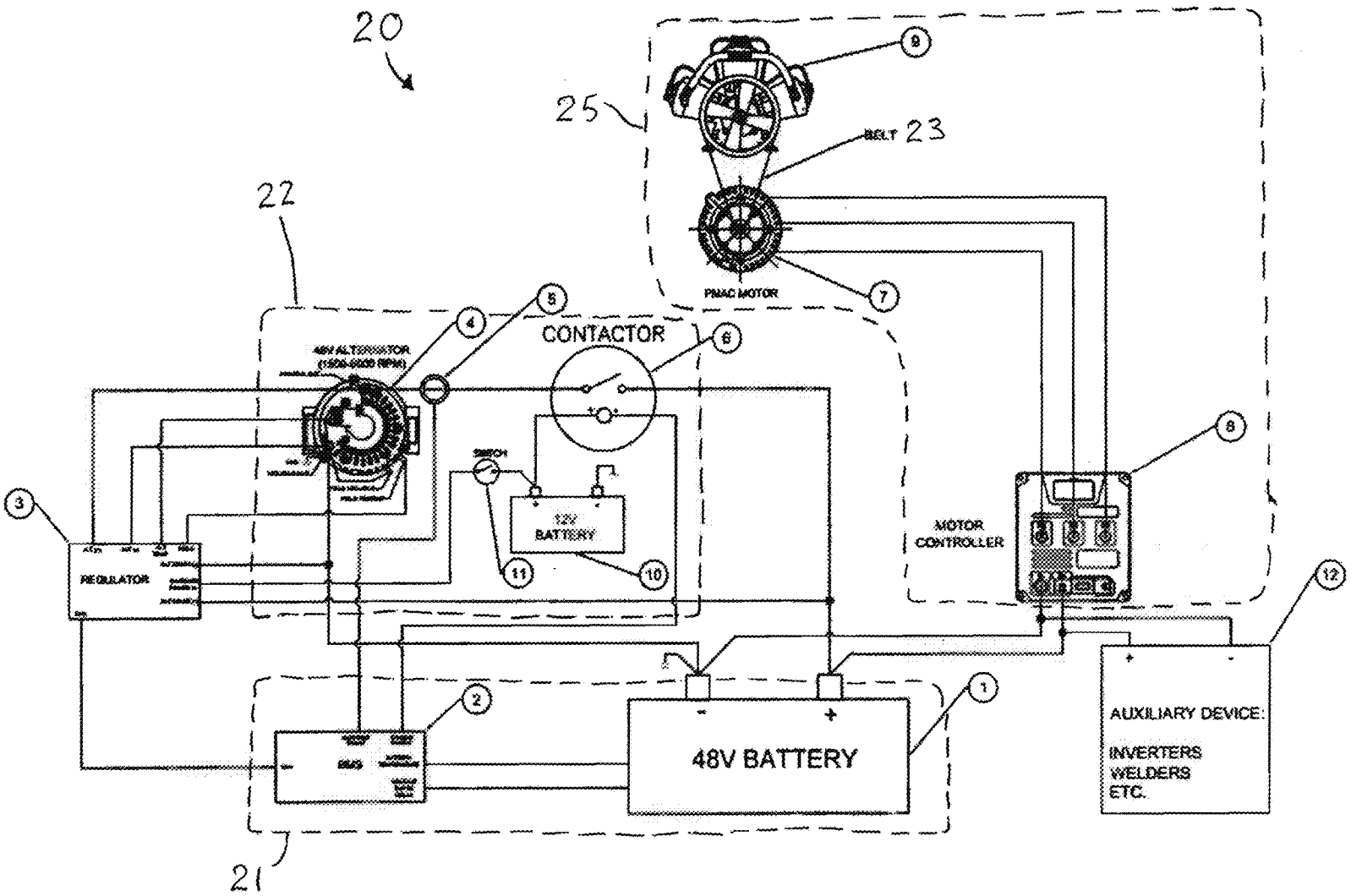
FIG. 1 is a schematic of an electric air compressor system in accordance with a nonlimiting embodiment of this invention.

The intended purpose of the following detailed description of the invention and the phraseology and terminology employed therein is to describe [what is shown in the drawings, which include the depiction of one or more nonlimiting embodiments of the invention, and to describe certain but not all aspects of what is depicted in the drawings, including the embodiment(s) depicted in the drawings. The following detailed description also identifies certain but not all alternatives of the embodiment(s) depicted in the drawings. As nonlimiting examples, the invention encompasses additional or alternative embodiments in which one or more features or aspects shown and/or described as part of a particular depicted embodiment could be eliminated, and also encompasses additional or alternative embodiments that combine two or more features or aspects shown and/or described as part of different depicted] embodiments. Therefore, the appended claims, and not the detailed description, are intended to particularly point out subject matter regarded to be aspects of the invention, including certain but not necessarily all of the aspects and alternatives described in the detailed description.

FIG. 1 schematically represents an electric air compressor system 20 according to a nonlimiting embodiment of the disclosure. The system 20 has an electric motor 7 that drives an air compressor 9 adapted for use in mobile applications, as nonlimiting examples, vehicle service or construction efforts. An electric power storage device, represented as a battery 1 in the nonlimiting embodiment of FIG. 1, provides electric power to the electric motor 7 to drive the electric motor 7. A motor controller 8 is operatively coupled with the electric motor 7 and the battery 1 to control operation of the electric motor 7, and as a result operation of the air compressor 9. An electric charging system 22 is operatively coupled to the battery 1 to provide electric power to recharge the battery 1. The electric charging system 22 is also operatively coupled with the electric motor 7 in parallel with the battery 1 via the motor controller 8 to provide a separate source of electric power to drive the electric motor 7. The electric charging system 22 may include, but is not limited to, a vehicle charging circuit through a DC-DC converter coupled to alternator driven by an internal combustion engine, a source of alternating current (AC) electrical power, as nonlimiting examples, from an electricity grid or from shore power in a marine application, and/or a stand-alone electricity generator. A battery management system 2 is coupled to the battery 1 to manage recharging of the battery 1. The battery management system 2 may be incorporated together as a unit with the battery 1 as part of a self-contained battery pack 21. A power regulator 3 is operatively coupled to the electric charging system 22 to control operation of the electric charging system 22 based on sensed operating parameters of components of the electric charging system 22 and/or the battery 1 to prevent or minimize system failures that may arise, for example from varying loads on the system or varying operational parameters. Various auxiliary devices 12, as nonlimiting examples, inverters, welders, generators, pumps, electrical chargers, may optionally by connected to the electric air compressor system 20, such as with the battery 1 and/or the electric charging system 22, thereby placing additional variable auxiliary power loads on the electric air compressor system 20. Each of these components is described in additional detail hereinafter.

Figure 5:
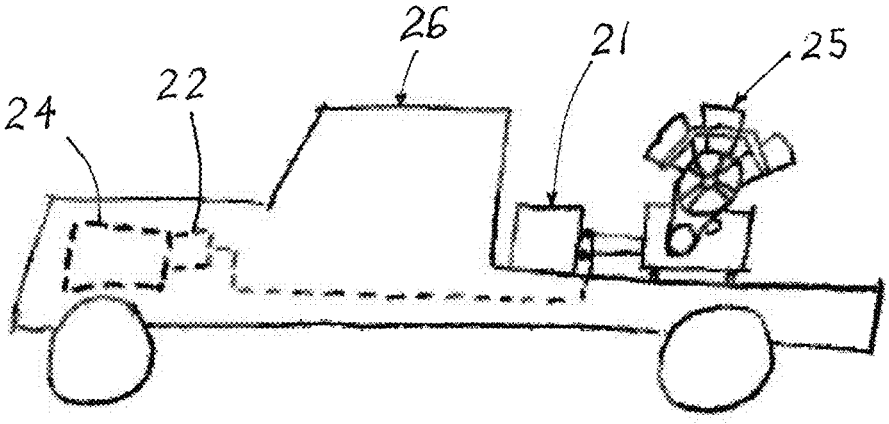
FIG. 5 is a diagrammatic view of an exemplary arrangement of the electric air compressor system of FIG. 1 implemented as part of an automotive platform.

The air compressor 9 can be of any type of air compressor that is driven by an external drive unit, including but not limited to, a reciprocating air compressor, a scroll air compressor, or a rotary screw air compressor. In certain embodiments the air compressor 9 may be incorporated as part of a portable or mobile self-contained apparatus, as nonlimiting examples, a portable compressor assembly 25 shown in FIGS. 2 and 3. In other embodiments the air compressor 9 may be integrated into a vehicle 26, as nonlimiting examples, a tow truck or utility vehicle used for mobile truck service or construction efforts as shown in FIG. 5, and utilize the vehicle's engine serpentine belt or power take off to drive an electric generator to power the system. Other implementation platforms for incorporating the air compressor 9 as part of an electric air compressor system 20 are also contemplated. In one arrangement, the air compressor 9 is a reciprocating compressor having an output capacity of greater than five cubic feet per minute of compressed air and having a ten gallon or larger air tank. The tank allows the electric air compressor system 20 to build and monitor air pressure such that the air compressor 9 can engage during air demand. The tank may also reduce pulsations caused by the compressing cycles of the air compressor 9. The air compressor 9 builds air pressure in the tank to a desired setting and then turns off automatically. The air compressor 9 does not start again until the motor controller 8 senses the pressure in the tank has dropped below a threshold setting. The air compressor 9 may have multiple fixed speeds that allow the electric air compressor system 20 to generate less compressed air than it is capable of to match required output and increase battery life. The air compressor 9 may be utilized in a variable speed mode, in which the air compressor 9 changes rotational speed to match desired air output. In each of these arrangements, because the air compressor 9 is driven directly from the electric motor 7, the speed of the air compressor 9 may be controlled by simply controlling the drive speed of the electric motor 7, for example, with the motor controller 8, in any suitable manner.

The electric motor 7 may be any type of electric motor suitable for driving the air compressor 9. For example, the electric motor 7 can be an AC motor or DC motor, a brush motor, or a brushless motor. The electric motor 7 may be a permanent magnet alternating current (PMAC) motor. In some arrangements, the electric motor 7 can be used in multiple single speed operation, such as in a high air output use scenario or low air output use scenario. In some arrangements, the electric motor 7 may be used in a variable speed operation such that the output from the air compressor 9 can match a variable usage requirement.

The motor controller 8 is configured to control operation of the electric motor 7 and thereby also operation of the air compressor 9. The motor controller 8 controls the power provided to the electric motor 7 from the electric charging system 22 and/or the battery 1 to control the speed and/or other operating parameters of the electric motor 7 in any manner understood in the art. For example, the motor controller 8 may control the speed and on/off state of the electric motor in response to the air pressure sensed from the tank or elsewhere as described above. The motor controller 8 may include one or more computer processors with hardware and/or software instructions configured to control the speed and on/off state of the electric motor 7 as described herein in any suitable manner.

Figure 2:
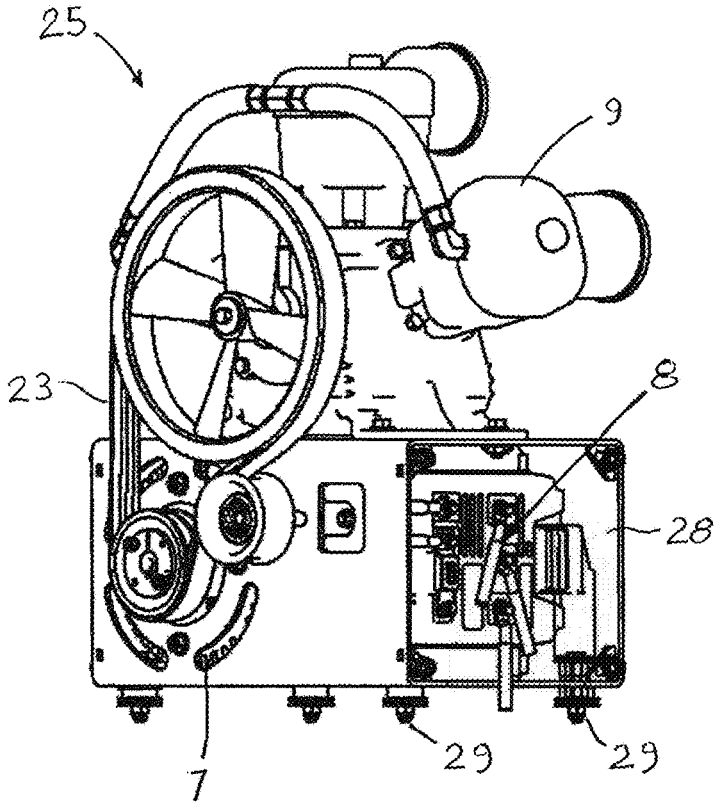
FIG. 2 is a perspective view of a portable compressor assembly of the electric compressor system of FIG. 1.
Figure 3:
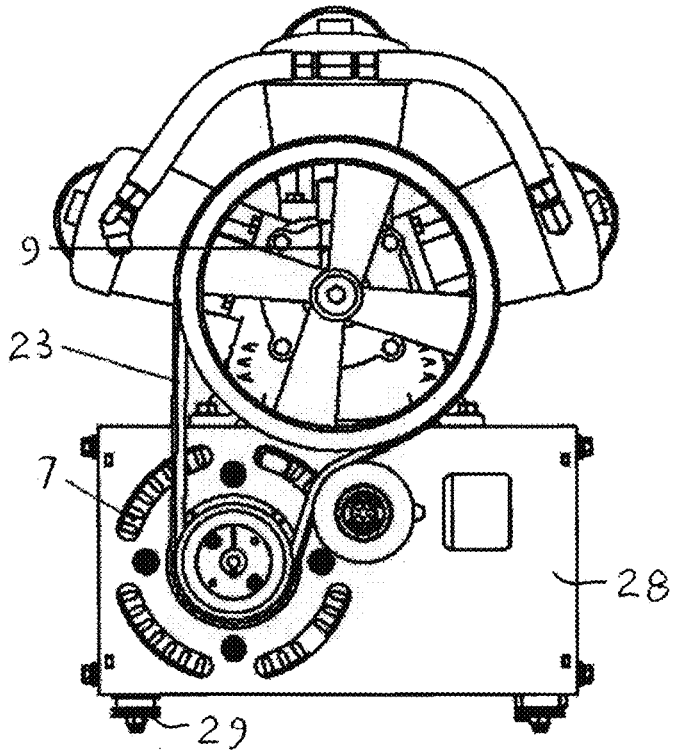
FIG. 3 is a front elevation view of the portable compressor assembly of FIG. 2.
Figure 4:
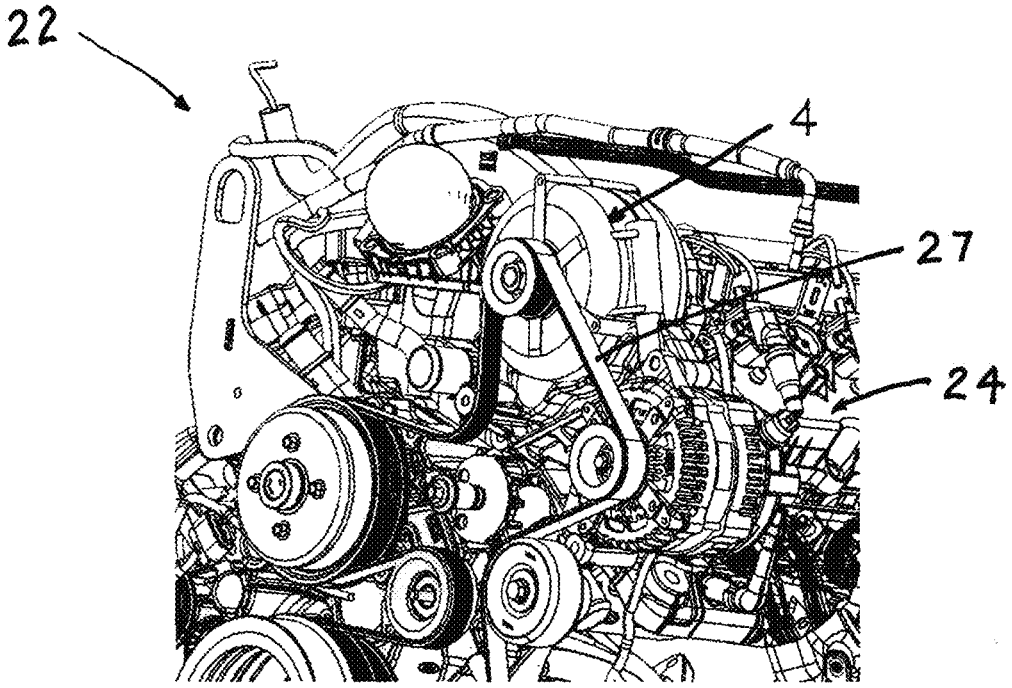
FIG. 4 is a partial perspective view of an exemplary electric generation subsystem for the electric air compressor system of FIG. 1.

With reference to FIGS. 2 and 3, the air compressor 9, the electric motor 7, and the motor controller 8 may form a portable compressor drive system that can be packaged together in a single assembly on a frame or cart 28, such as the portable compressor assembly 25. Each of the air compressor 9, the electric motor 7, and the motor controller 8, are represented as carried by the cart 28 so that they all can be easily moved together as a single unit. In this example, the air compressor 9 is fixedly mounted on top of the cart 28, and the electric motor 7 and the motor controller 8 are fixedly mounted inside the cart 28. A drive linkage 23, as a nonlimiting example, a serpentine belt, is shown as operatively coupling the drive spindle of the electric motor 7 to the drive wheel of the air compressor to drive the air compressor 9. Electrical connectors of the motor controller 8 are shown as being accessible through an opening in a sidewall of the cart 28 for connecting to electric power leads, such as from the battery 1 or electric charging system 22. The cart 28 may include legs and/or casters 29 on the bottom of the cart to provide for easier movement of the portable compressor assembly 25. In this arrangement, the portable compressor assembly 25 may be more easily moved around relative to the battery 1 and/or the electric charging system 22, for example to get closer to a work item in the field. With reference to FIGS. 4 and 5 for example, the portable compressor assembly 25 may be carried on a vehicle 26 to a remote work location, as nonlimiting examples, a construction site or a vehicle service site. The electric charging system 22 and/or the battery pack 21 may be fixedly mounted to the vehicle 26, while the portable compressor assembly 25 may be unattached or easily removed from the vehicle 26. Electric power wires allow the portable compressor assembly 25 to be moved closer to a desired work area or work piece while still being able to receive the needed electrical power from the electric charging system 22 and/or the battery 1 still mounted to the vehicle 26.

The battery 1 provides storage for electric power for use in powering the electric motor 7. Such electric power storage may be provided in any suitable form of chemical, mechanical, and/or capacitive storage, and unless otherwise stated, the term battery is used herein to refer to any suitable form of electric power storage device. The battery 1 is of a size and capacity suitable for powering the electric motor 7 to drive the air compressor 9. For example, the battery 1 may be a high voltage battery with an output greater than thirty-six volts. The battery 1 is preferably rechargeable such that it may be recharged by an electrical charging source, such as the electric charging system 22. In one arrangement, the battery 1 is incorporated as part of a 48V DC-5 KW battery pack 21 containing its own battery management system 2 as described hereinafter. The battery 1 can be charged and/or recharged via an electrical charging source, as a nonlimiting example, a vehicle charging circuit through a DC-DC converter, a connection to shore power or other electric power source, a power generator incorporated into the vehicle, or a stand-alone power generator. Other types and sizes of batteries may be used.

The battery management system 2 monitors operation of the battery 1 and controls recharging of the battery 1. The battery management system 2 may be any suitable battery management system for monitoring various operating parameters of the battery, as nonlimiting examples, temperature, voltage, state of charge, depth of discharge, and other parameters commonly monitored in the art. The battery management system 2 may include one or more computer processors with hardware and/or software instructions configured to monitor the operating parameters of the battery 1 and provide sensed parameter data to the power regulator 3 and/or to communicate with a current shunt 5, which may include a Hall effect sensor, in the line connecting the electric generator 4 with the positive terminal of the battery 1. Many suitable battery management systems are available and are well understood in the art. The battery management system may be separate from the battery 1 or may be integrated with the battery 1 in a single unit as part of the battery pack 21.

The electric charging system 22 may be any system that is suitable for providing electrical power for charging the battery 1 and/or supplying electrical power directly to the electric motor 7 to drive the air compressor 9. Depending on the type of electric power required to drive the electric motor 7, the electric charging system may include a DC generator and/or an AC generator. The electric charging system 22 may be electricity grid power, shore power, or provide DC power from a DC-DC converter. Shore power may come in the form of Level 1, Level 2, or Level 3 charging stations. In other arrangements, the electric charging system 22 may include an AC power to DC power charger connected to a source of AC power, as nonlimiting examples, from an electricity grid or an AC generator. If the user does not wish to recharge the battery 1, a used battery 1 could be exchanged with a new charged battery 1 as needed.

FIGS. 4 and 5 show one contemplated mobile platform arrangement in which the electric charging system 22 is incorporated into the powertrain or auxiliary drive of a vehicle 26, as nonlimiting examples, a tow truck or other service automobile. In other arrangements, the vehicle 26 could be a marine vehicle, as nonlimiting examples, a boat or ship with power generation unit, or a railroad vehicle with a power generation unit, as a nonlimiting example, a locomotive. In other arrangements, the electric charging system 22 may be powered by a standalone power-train unit not used to drive a motor vehicle, such as an Air N Arc® power system by Vanair Manufacturing, Inc. The electric charging system 22 includes an electric generator 4, such as an alternator, driven by a power unit 24, as a nonlimiting example, an internal combustion engine. The electric generator 4 may be the primary alternator for the vehicle 26 or the electric generator 4 may be an auxiliary alternator for providing auxiliary power to an auxiliary power circuit. The electric generator 4 as shown in FIG. 4 is an auxiliary alternator. The electric generator 4 may be a heavy-duty alternator that produces more than thirty-six volts and more than two thousand five hundred Watts, although other types and sizes may be used. The electric generator 4 may incorporate one or more over voltage diodes to prevent power generation above some predetermined system component potential safety threshold. The electric generator 4 is electrically coupled to the battery 1 and to the electric motor 7 in a manner well understood in the art. A contactor 6 may be provided, for example in the circuit leg from the electric generator 4 to a positive terminal of the battery 1, to control flow of electric power from the electric generator 4 to the battery 1 and/or the electric motor 7, and/or any auxiliary devices 12.

The electric charging system 22 battery 1, and electric motor 7 are preferably interconnected in a hybrid arrangement in which the electric motor 7 can receive power from both the electric charging system 22 and the battery. The electric charging system 22 is connected with each of the battery 1 and the electric motor 7 in parallel. The battery 1 is also connected with the electric motor 7 in parallel with the electric charging system 22. In this way, the electric motor 7 may be powered by either or both of the electric charging system 22 and the battery 1. Further, the battery 1 may be recharged by the electric charging system 22 when the electric motor 7 is not running or requires less power than is being produced by the electric charging system 22. In other situations, the battery 1 may supplement power delivered to the electric motor 7 when the electric motor requires more power than the electric charging system 22 can provide. In yet other situations, the battery 1 may provide the entire power load for the electric motor 7 when the electric charging system 22 is not operational. In even further situations, the electric charging system 1 may provide the entire power load for the electric motor 7 when the battery 1 is unable to provide any power.

The power regulator 3 monitors various operating parameters of the electric charging system 22 and the battery 1 and controls operation of the electric generator 4 to prevent undesirable operating states, such as undesired shut down of the entire system or other undesirable circumstances. The power regulator 3 may also control operation of the electric generator 4 and/or other portions of the electric charging system 22 to help manage recharging of the battery 1. The power regulator may include one or more computer processors with hardware and/or software instructions to perform any one or more of the functions described herein in any suitable manner.

The power regulator 3 may be configured to prevent undesirable operation states of the electric generator 4. In one configuration, the power regulator 3 is operatively coupled to the electric generator 4 and monitors the temperature of the electrical generator 4 using one or more temperature sensors. If the temperature of the electric generator 4 rises above a determined value, such as a predetermined safety threshold, the power regulator 3 reduces the output of the electric generator 4, which will reduce total produced heat. This allows the electric generator 4 to self-cool with limited use. If the temperature of the electric generator 4 continues to rise, the power regulator 3 can turn off the output of the electric generator 4 completely. In the present arrangement, to control the output of the electric generator 4, the power regulator 3 controls a switch 11 connected to a battery 10, as nonlimiting examples, a 12V marine or automotive battery of the vehicle's primary power system, for the electric charging system 22, which in turn controls operation of a contactor 6 that opens and closes the circuit leg between the electric generator 4 and the positive terminal of the battery 1. However, other control circuit arrangements may be implemented.

The power regulator 3 may be configured to help regulate charging of the battery 1. for example, the power regulator 3 may utilize multi-stage battery charging to achieve quickest recharge rates of the battery 1 and also ensure longest life of the battery 1. In one configuration, the power regulator 3 is operatively coupled with the battery 1 and/or the battery management system 2. The power regulator 3 monitors the temperature of the battery 1, for example with temperature sensors mounted within the battery or from temperature values broadcasts by the battery management system 2 via suitable wired or wireless communication lines. If the battery is cold, i.e., has a temperature below a selected temperature threshold, the power regulator 3 prevents full power from the electrical generator 4 from being provided to the battery, for example by controlling operation of the contactor 6. As the temperature of the battery 1 increases, the power regulator 3 slowly increases the power delivered from the electric generator 4 to the battery 1. If the temperature of the battery 1 exceeds a selected temperature at which fast charging is not acceptable, the power regulator 3 decreases output charge from the electric generator 4 to the battery 1 accordingly.

The power regulator 3 may be configured to reduce or prevent slippage of a drive belt 27 that drives the electric generator 4, which can be important to uptime. For example, if the electric generator 4 is being powered from the serpentine drive belt 27 of the vehicle 26, belt slip may render the vehicle 26 unable to drive. In one configuration, the power regulator 3 monitors current output from the electric generator 4 and speed of the electric generator 4. The power regulator 3 reduces power output of the electric generator 4 based on a predicted load verses the speed of the electric generator 4 in anticipation of belt slip. When the electric generator 4 is active, the power regulator 3 slowly increases the power output produced by the electric generator 4 in accordance with a predefined function. The power regulator 3 senses when the electric generator 4 is turned on and waits for a selected period of time prior to applying power to the fields of the electric generator 4. This can reduce belt slip and wear and tear on the drive system into which the electric generator 4 is incorporated.

In one arrangement in which the electric air compressor system 20 is powered by an electric generator 4 in the form of an alternator that is incorporated into the vehicle 26, the power regulator 3 monitors power output, temperature, and rotations per minute of the alternator. The power regulator is configured to slowly start the electric charging system 22 and reduce output of the alternator based on monitored sensor values of the power output, temperature, and RPMs of the alternator. The power regulator 3 and the battery management system 2 communicate safety parameters and sensors values, as nonlimiting examples, power output values, temperature values, and voltage values, to be self-limiting to ensure uninterrupted compressed air use under varying electrical loads and operating parameters.

Various auxiliary devices 12 that require an electrical load may be powered from the power provided by the battery 1 and/or the electric charging system 22. The auxiliary devices may be connected in parallel with the motor controller 8 and the electric motor 7 to receive power from either or both of the battery 1 and the electric charging system 22. Such auxiliary devices may include, but are not limited to, air conditioning components, hydraulic power components, HVAC components, welding components, and jumpstarting capabilities. When such auxiliary devices 12 are drawing power from the electric charging system 22 and/or the battery 1, the power regulator 3 can help prevent undesirable operation of the entire system caused by temporarily increased or decreased power draws from the electrical charging system 22 and/or the battery 1 in the manner previously described with respect to the air compressor 9. Thus, the electric air compressor system 20 can be expanded in many different ways while reducing or eliminating possible faults that could be caused by such temporary changes to the power load.

The electric air compressor system 20 described herein may provide for a more flexible and scalable solution for mobile power systems in general than previously available from conventional mobile power systems. In one example, electric air compressor system 20 allows additional air capacity to be easily added at any time. If more air capacity is needed, a larger air compressor or a second electric air compressor drive system can be added by hooking into the battery 1 and/or the electric charging system 22. With a conventional mobile air compressor system driven by an internal combustion engine, if an air compressor is integrated into a vehicle's drive system, expanding the air capacity can be hindered by space limitations and drive system capabilities by means of limited installation choices. However, by utilizing a hybrid system in accordance with the electric air compressor system 20, installation options are greatly expanded, and thereby the number of areas on the vehicle where air compressor components can be installed.

In another example, if more compressed air usage time is required, a larger battery 1 or a second battery 1 can be added to the system. Currently, with an air compressor system powered by a conventional internal combustion engine mobile power system, if more usage time is needed, the current equipment would need to be removed and a different system installed. However, with an electric air compressor system 20, if an auxiliary piece of equipment is required to expand capability, it can easily be added to the system without overloading the system. This includes, but is not limited to, AC power, Hydraulic Power, HVAC requirements, welding, and jumpstarting capabilities.

Different arrangements and configurations of the various systems and components are contemplated. In some arrangements, the electric air compressor system 20 may be incorporated with a vehicle. The vehicle's electric generator 4 powers the electric motor 7, which drives the air compressor 9. In some arrangements, multiple air compressors 9 may be powered by the vehicle's electric generator 4. In some arrangements, the battery 1 powers the electric motor 7 to drive the air compressor 9. Again, this arrangement can be modified such that multiple air compressors 9 may be powered from the battery 1. In some arrangements, both an electric generator 4 and a battery 1 may be coupled to the electric motor 7 that drives the air compressor 9. The electric generator 4 can directly power the electric motor 7 or can recharge the battery 1 or can simultaneously power the electric motor 7 and recharge the battery 1. This arrangement can also be modified such that multiple air compressors 9 are powered from the electric generator 4 and/or the battery 1. These are just three possible arrangements and are not inclusive of all possible arrangements. Any arrangement and configuration of the components and systems described herein suitable for driving the air compressor 9 with the electric motor 7 in a manner consistent with the description herein is contemplated and included. Additional arrangements and configurations are also contemplated as described hereinafter.

The electric air compressor system may include auto start and stop behaviors based on air demand to save system component wear and extend battery life.

The electric air compressor system may operate at single speed or may operate at multiple speeds.

The electric air compressor system may have the ability to utilize variable speed to match air demand with air production.

The electric air compressor system may have a brushed electric motor or a brushless electric motor.

The electric air compressor system may be configured to move a minimum of five cubic feet per minute.

The electric air compressor system may include a high voltage DC battery with a minimum of thirty-six volts and a capacity of at least 2.5 KW.

The electric air compressor system may include a high voltage alternator having an output capacity of thirty-six volts or higher.

The electric air compressor system may include a power regulator that regulates the electric generator.

The power regulator may communicate with the battery management system.

The power regulator may communicate with the motor controller.

The power regulator may implement multi-stage charging of the battery.

The power regulator may monitor the temperature of the electric generator.

The power regulator may reduce output of the electric generator based on the temperature of the battery.

The power regulator may monitor the speed of the electric generator. The power regulator reduces output of the electric generator based on belt slip detection.

The power regulator may increase power of the electric charging system with an onset delay.

The electric air compressor system may allow vehicle communication and integration allowing high idle during stationary applications to increase alternator output power.

The electric generator may operate during normal vehicle operation allowing battery charging while driving.

The electric air compressor system may include a DC-DC converter to charge the batter from native vehicle voltage.

The electric air compressor system may utilize a battery already incorporated in the vehicle power system.

The electric air compressor system may provide for data sharing between components as more components are connected into the system. This data can be used to control, command, and/or react to operating conditions and/or parameters between the components.

The electric air compressor system may provide load sharing and function prioritization that can be set by a user or can occur automatically.

The electric air compressor system may provide fault detection and/or data logging.

The electric air compressor system may provide wireless data communication between various components of the system.

The electric air compressor system may provide data communication between components in a wired fashion, as nonlimiting examples, via a data bus or discrete inputs and outputs.

As previously noted above, though the foregoing detailed description describes certain aspects of one or more particular embodiments of the invention [and investigations associated with the invention], alternatives could be adopted by one skilled in the art. For example, the electric air compressor system and its components could differ in appearance and construction from the embodiments described herein and shown in the figures, functions of certain components of the system could be performed by components of different construction but capable of a similar (though not necessarily equivalent) function, and various materials could be used in the fabrication of the system and/or its components. As such, and again as was previously noted, it should be understood that the invention is not necessarily limited to any particular embodiment described herein or illustrated in the drawings.

The invention claimed is:

1. An electric air compressor system comprising:

an air compressor operable to produce compressed air, the air compressor being operable at variable speeds to match air demand of multiple varying loads on the electric air compressor system with the compressed air produced by the air compressor;

an electric motor configured for driving the air compressor;

a motor controller that controls operation of the electric motor;

an electric power storage device configured for providing electric power to the electric motor;

an electric charging system operatively coupled to the electric power storage device and to the electric motor, the electric charging system comprising an alternator, driven by an internal combustion engine, and configured for providing electric power to the electric power storage device to recharge the electric power storage device and to the electric motor to drive the air compressor;

a contactor located along an electrical circuit leg that extends from the alternator to both of the electric power storage device and the motor controller, and a power regulator operatively coupled to the electric charging system and comprising a processor configured to control operation of the alternator, the processor controlling the electric power produced by the alternator based on sensed operating parameters of the electric charging system and the electric power storage device to prevent or minimize failures in the electric air compressor system, the sensed operating parameters including:

a sensed electrical current output of the alternator to the electric power storage device and/or the electric motor, and a sensed temperature of the alternator wherein the power regulator reduces power output of the alternator when the sensed temperature of the alternator exceeds a predetermined threshold, and further wherein the power regulator controls operation of the contactor, based on the sensed temperature of the alternator, to open the contactor and block the electrical current output of the alternator from both of the electric power storage device and the motor controller.

2. A power regulator operatively coupled to an electric charging system for controlling operation of an air compressor system having an alternator, driven by an internal combustion engine, that provides electrical power to an electric power storage device and to an electric motor to drive an air compressor that is operable at variable speeds to match air demand of multiple varying loads on the air compressor system with compressed air produced by the air compressor, the power regulator comprising:

a processor configured to control operation of the alternator and control the electric power provided thereby to match the air demand of the multiple varying loads on the air compressor system with the compressed air produced by the compressor, the processor controlling the electric power produced by the alternator based on sensed operating parameters of the electric charging system and the electric power storage device to prevent or minimize failures in the air compressor system, the sensed operating parameters including:

a sensed electrical current output of the alternator to the electric power storage device and/or the electric motor, and a sensed temperature of the alternator wherein the power regulator reduces power output of the alternator when the sensed temperature of the alternator exceeds a predetermined threshold, and wherein the air compressor system includes a motor controller that controls operation of the electric motor, and a contactor located along an electrical circuit leg that extends from the alternator to both of the electric power storage device and the motor controller, and further wherein the power regulator controls operation of the contactor, based on the sensed temperature of the alternator, to open the contactor and block the electrical current output of the alternator from both of the electric power storage device and the motor controller.

3. The electric air compressor system of claim 1, wherein the power regulator reduces power output of the alternator based on a predicted load verses a sensed speed of the alternator in anticipation of slippage of a drive belt that drives the alternator to reduce or prevent slippage of the drive belt.

4. The electric air compressor system of claim 1, wherein, based on the sensed electrical current output, the power regulator regulates the electrical current output from the alternator to prevent full power from the alternator from being provided to the electric power storage device when a sensed temperature of the electric power storage device is below a first selected temperature threshold.

5. The electric air compressor system of claim 4, wherein the power regulator regulates the electrical current output from the alternator to decrease output charge from the alternator when a sensed temperature of the electric power storage device is above a second selected temperature threshold.

6. The power regulator of claim 2, wherein the power regulator reduces power output of the alternator based on a predicted load verses a sensed speed of the alternator in anticipation of slippage of a drive belt that drives the alternator to reduce or prevent slippage of the drive belt.

7. The power regulator of claim 2, wherein, based on the sensed electrical current output, the power regulator regulates the electrical current output from the alternator to prevent full power from the alternator from being provided to the electric power storage device when a sensed temperature of the electric power storage device is below a first selected temperature threshold.

8. The power regulator of claim 7, wherein the power regulator regulates the electrical current output from the alternator to decrease output charge from the alternator when a sensed temperature of the electric power storage device is above a second selected temperature threshold.

9. The electric air compressor system of claim 1, wherein the processor is configured to the control the electric power produced by the alternator to match the air demand of the multiple varying loads on the electric air compressor system with the compressed air produced by the compressor.

10. The electric air compressor system of claim 9, wherein the sensed operating parameters further include:

a sensed temperature of the electric power storage device; and a sensed speed of the alternator.

11. The power regulator of claim 2, wherein the sensed operating parameters further include a sensed temperature of the electric power storage device, and a sensed speed of the alternator.

* * * * *